United States Patent [19]

Griffith

[11] Patent Number: 4,596,253

[45] Date of Patent: Jun. 24, 1986

[54] ABDOMINAL SUPPORT GARMENT

[76] Inventor: Johnnie R. Griffith, 723 "D", Snohomish, Wash. 98290

[21] Appl. No.: 714,631

[22] Filed: Mar. 21, 1985

[51] Int. Cl.[4] ..... A41C 1/08; A41C 1/00

[52] U.S. Cl. ..... 128/579 R; 128/519

[58] Field of Search ..... 128/579, 519; 2/236, 2/237, 306

[56] References Cited

U.S. PATENT DOCUMENTS

| | | | |
|---|---|---|---|
| Re. 26,360 | 3/1968 | Pagano | 128/519 |
| 2,481,396 | 9/1949 | Cohen | 128/519 |
| 2,710,486 | 6/1955 | Blatt | 2/41 |
| 2,862,499 | 12/1958 | Blatt | 2/306 |
| 2,997,044 | 8/1961 | Simons | 128/519 |
| 3,068,871 | 12/1962 | Rapp | 128/519 |
| 3,127,896 | 4/1964 | Puliafico | 2/227 |
| 3,174,482 | 3/1965 | Parrott | 2/404 |
| 3,185,158 | 3/1965 | Gattuso | 2/236 |
| 3,234,947 | 2/1966 | Bergstein | 2/237 |
| 3,454,003 | 7/1969 | Kleber-Sailhen | 128/159 |
| 3,457,926 | 7/1969 | Bacon et al. | 2/237 |
| 3,527,232 | 9/1970 | Rocker | 2/306 |

*Primary Examiner*—Doris L. Troutman

*Attorney, Agent, or Firm*—Christensen, O'Connor, Johnson & Kindness

[57] ABSTRACT

A garment that works in response to the degree of correction needed to support the anterior abdominal wall and provide a cosmetic reshaping of the abdomen to yield a flat appearance. A support panel (10) has three elastic webs (12, 14, 16) with their respective grains running at contrasting angles. When in use, the support panel is positioned on the lower abdomen and the webs interact with one another so that the support panel assumes a pouch-like shape that holds and lifts the abdomen. A shaping panel (40) is connected to the waistband and positioned in front of the support panel (10). The shaping panel (40) includes two elastic side webs (44,46) that interact with a nonelastic central web (42) to cause the shaping panel to assume a curvilinear operative configuration. A lower portion of the shaping panel conforms to the pouch-like shape of the support panel and cooperates therewith to hold and lift the abdomen. An upper portion of the shaping panel remains substantially flat and operates against the abdomen to spread the same between the hipbones and provide a flat appearance.

9 Claims, 6 Drawing Figures

ABDOMINAL SUPPORT GARMENT

BACKGROUND OF THE INVENTION

The present invention relates generally to wearing apparel, and, more particularly, to a woman's undergarment that supports and reshapes the lower abdominal wall for both comfort and appearance.

As a result of either weakened abdominal muscles or an abundance of adipose tissue, some persons develop a distention of the lower abdomen. Such a distention is not only aesthetically unpleasing, but also the cause of physical discomfort. In women, the problem is particularly acute since the distention most frequently occurs in the lower area of the abdomen, i.e., below the waistline in the anterior wall adjacent the pelvic cavity. With the lower abdominal muscles weakened, the uterus, bladder, and other organs within the pelvic cavity fall from their normal anatomical position, causing pain and, often, menstrual difficulties.

The discomfort resulting from distention of the abdomen is not confined solely to the pelvic region but may also occur in the lower back. Although not attributable necessarily to weakened abdominal muscles or excessive fat deposits, lower back pain is also a frequent problem for women during pregnancy.

Various forms of separate undergarments, such as girdles, and inserts or accessory appliances for outer garments have been heretofore proposed as means for controlling the abdomen so as to improve the appearance of the wearer. The typical approach has been to form the garment from an elastic material in such a manner that the abdomen is compressed inwardly and confined in a restricted position. While these approaches do provide some improvement in appearance by compressing the abdomen into a somewhat smaller size, they do so at the cost of decreasing, rather than increasing, the comfort of the wearer. The improvement in appearance is also often marginal since unsightly bulges or wrinkles are frequently created when fatty tissue is compressed or confined.

Prior undergarments of the girdle type typically include elastic side and rear panels that are interconnected with the abdominal panel to form a garment that completely encircles the wearer's trunk. Such garments not only compound the problems of discomfort and bulges, but also tend to roll, crease, or ride up or down on the wearer. In recognition of these problems, some girdle-like garments have been formed in the manner of pants to extend through the crotch. The disadvantages and discomfort of this type of garment are quite well known.

In other prior undergarments, where the crotch and buttocks are not covered, it has been necessary to utilize auxiliary means, such as garters attached to the garment, in order to maintain the garment in a proper position.

In contrast to the girdle, or body-encircling, type of garment, another approach to abdominal control has been to combine an elastic insert or panel with an outer garment. Appliances of this type are most often elastic panels or elastically biased panels that are incorporated into the garment, such as by sewing into the waistband or side seams. When the garment is worn, these panels stretch across the abdomen and, because of their attachment to the seams, press inwardly against the abdomen. Although such devices do compress the abdomen to a minor degree and, thus, provide a measure of improvement in appearance, they are not entirely satisfactory. In particular, such devices are not capable of supporting or lifting the abdominal wall. This deficiency is attributable, in part, to the aesthetic necessity of incorporating the device in the garment and having it operate in a manner that will neither wrinkle the outer garment nor provide other visual clues to its presence. As a consequence of this limitation, it has not been possible to arrange devices of this type so as to provide lifting support of the abdominal wall. Of equal importance with the inability of such combined compressive panels/outer garments to provide abdominal support is the commercial disadvantage of requiring a specialized garment. From both a functional and fashion standpoint, it is not possible to adapt this arrangement to a wide variety of clothing. From an economic standpoint, such construction is more costly than a conventional garment, presenting greater risk of losses to both manufacturers and retailers in the event that these specialized garments cannot be sold at the anticipated price.

From the foregoing, it will be appreciated that there is a need for an abdominal control garment which supports and reshapes the lower abdomen in a comfortable and aesthetic manner so as to return the abdomen to its correct position and give the appearance of a trim profile. The present invention fills this need and provides a universal undergarment that can be worn under, and remain visually undetectable under, any conventional women's garment. In accordance with an important aspect of the invention, a unique principle is used to support and reshape the abdomen without restricting movement and without general compression of the abdomen. Unlike girdles and girdle-like garments, the present invention does not utilize elastic panels or bands that encircle the wearer and compress the hips, waist, lower back, or buttocks. Rather, the invention acts only upon the abdomen with a twofold action, which first provides a cupping support that lifts and holds the lower abdomen and which secondly flattens the portion so lifted by redistributing it laterally towards the hips. In accordance with a unique aspect of the invention, the cupping support action that lifts the abdomen inwardly and upwardly increases in efficiency with the quantity of tissue and degree of flaccidity requiring correction. In this manner, the invention not only provides the requisite support for the abdominal wall and for the organs of the pelvic cavity, but also ensures that the garment will not twist, ride up or down, or otherwise be displaced as a result of the wearer's movements. An unusual degree of comfort and stability is thereby achieved without necessitating the involvement of the crotch or buttocks or the use of auxiliary position-stabilizing means such as garters.

SUMMARY OF THE INVENTION

In accordance with the invention, there is provided a garment that works together with wearer's body to lift and reshape the anterior abdominal wall into an approximation of its original taut configuration. This is accomplished by a pair of cooperating panels which overlie and act only upon that portion of the abdomen which is adjacent the pelvic cavity in the region from just above the crotch to the waistline. The inventive garment includes a waistband that is adapted, when in use, to engage the posterior portion of the natural waistline of the wearer and extend around to the sides of the waistline in the vicinity of the hipbones. A support panel is connected at opposite sides thereof to the waistband to form a belt-like structure that encircles the trunk of the wearer. In use, the support panel is positioned on the lower abdomen so as to engage a distended portion thereof. In operation, the support panel assumes a pouch-like shape in response to the protruding abdomen. As a consequence, the support panel holds and lifts the abdomen. Where the wearer's abdomen has fallen because of weakened abdominal muscles, the cupping, lifting support action of the support panel returns the abdominal wall and underlying organs to their proper anatomical positions. As a result, the wearer enjoys a marked increase in comfort.

Where relief from the painful consequences of a protruding abdomen is the only concern, the combination of a support panel and waistband according to the invention offers an effective solution. It is an important aspect of the invention, however, to provide not only comfort through proper support of the abdominal wall, but also to provide a cosmetic reshaping of the abdomen to yield a flat appearance, i.e., an arbitrary "fashion flat" appearance that conforms in a natural way with clothing of conventional design and that gives the visual illusion of a loss of weight. To accomplish this, the invention includes a shaping panel that is connected at opposite sides thereof to the waistband. The shaping panel is larger in surface area than the support panel, having a lower portion, which is superimposed over the support panel, and an upper portion, which is positioned above the support panel so as to engage, when in use, that portion of the abdomen which lies between the support panel and the waistline of the wearer. In operation, the lower portion of the shaping panel responds to an abdominal protrusion so as to assume a shape that conforms to the pouch-like shape of the support panel. In this manner, the lower portion of the shaping panel cooperates with the support panel to hold and lift the abdomen. This cooperative lifting action works inwardly and upwardly and, in so doing, causes the portion of the abdomen lying above the support panel and generally below the navel to be forced outward into a bulge or paunch. The upper portion of the shaping panel flattens this paunch by pushing gently inward on the center thereof and pulling sideswards thereon to spread the same between the hipbones to yield a more pleasing appearance. The actual resulting shape will vary depending upon the woman's body shape and weight. In general, it is characterized by an absence of the protrusion that previously existed and, by a more natural, somewhat rounded silhouette.

In accordance with a further aspect of the invention, it is important from an aesthetic standpoint to keep the supporting, flattening action of the garment hidden from view when worn under conventional garments. The positioning of the inventive garment, and its operation only upon the lower anterior portion of the abdomen, to a substantial extend achieves the aim of providing hidden support and shaping. To further assure that no bulges or crease lines occur along the lower edge of the garment, it is preferred that the lower portion of the shaping panel assume a generally S-shape in the cross section. With this arrangement, the upper portion of the "S" conforms to the pouch-like shape of the support panel while the lower portion of the "S" curves gently outward. When in use, this outwardly curving portion of the shaping panel conforms to the more flattened contour of a wearer's abdomen, which in most women naturally occurs immediately below an abdominal distention.

In preferred form, the support panel and shaping panel each have three distinct webs that functionally cooperate with one another. In particular, each panel has a central web flanked by a pair of opposed side webs. In the support panel each of the webs is constructed of an elastic material. In the shaping panel, however, only the two side webs are constructed of an elastic material, with the central web being constructed of a nonelastic material. The elastic material for each of the various webs has a grain that denotes the direction of maximum elasticity. For both the support panel and the shaping panel the grains of the component webs are oriented in a predetermined manner relative to one another so that the webs elastically interact when worn, to cause each of the panels to change from a relatively flat configuration to a configuration that effects the intended action on the abdomen, i.e., lifting support for the support panel, and both lifting support and flattening for the shaping panel. In the support panel, the grain of the elastic material forming the central web is oriented in a generally horizontal direction so that the central web stretches mostly in a sideways direction. The grain of each of the side webs is oriented in a predetermined direction relative to the grain of the central web so as to stretch mostly in a direction that is at an angle relative to the direction of stretch of the central web. As a result of the directional relationships between their respective grains, the central and side webs of the support panel interact with one another when stretched. This interaction causes the panel to bow inwardly, substantially along its entire lateral dimension, into a curvilinear, pouch-like configuration that is generally an open C-shape in cross section.

In the shaping panel, the respective grains of the elastic material in the side webs are oriented in predetermined directions relative to one another so as to act, when stretched, at different angles on the opposite sides of the nonelastic central web. This elastic interaction of the central and side webs causes the lower portion of the panel to assume the curvilinear S-shape discussed above and causes the upper portion to assume a generally flat configuration.

In accordance with a further aspect of the invention, the technique of comformably lifting the abdomen without compression or restriction is employed to provide a support for women during pregnancy. According to this alternative embodiment, no flattening of the abdomen is desired or is achieved. Instead, an outer pouch is used in conjunction with an intermediate support panel, an inner support panel, and a waistband to form a garment that lifts and supports the abdomen and transfers a portion of the weight of the fetus to the hipbones.

BRIEF DESCRIPTION OF THE DRAWINGS

The invention can best be understood by the following portion of the specification taken in conjunction with the accompanying drawings in which.

DETAILED DESCRIPTION OF THE PREFERRED EMBODIMENT

Figure 1:
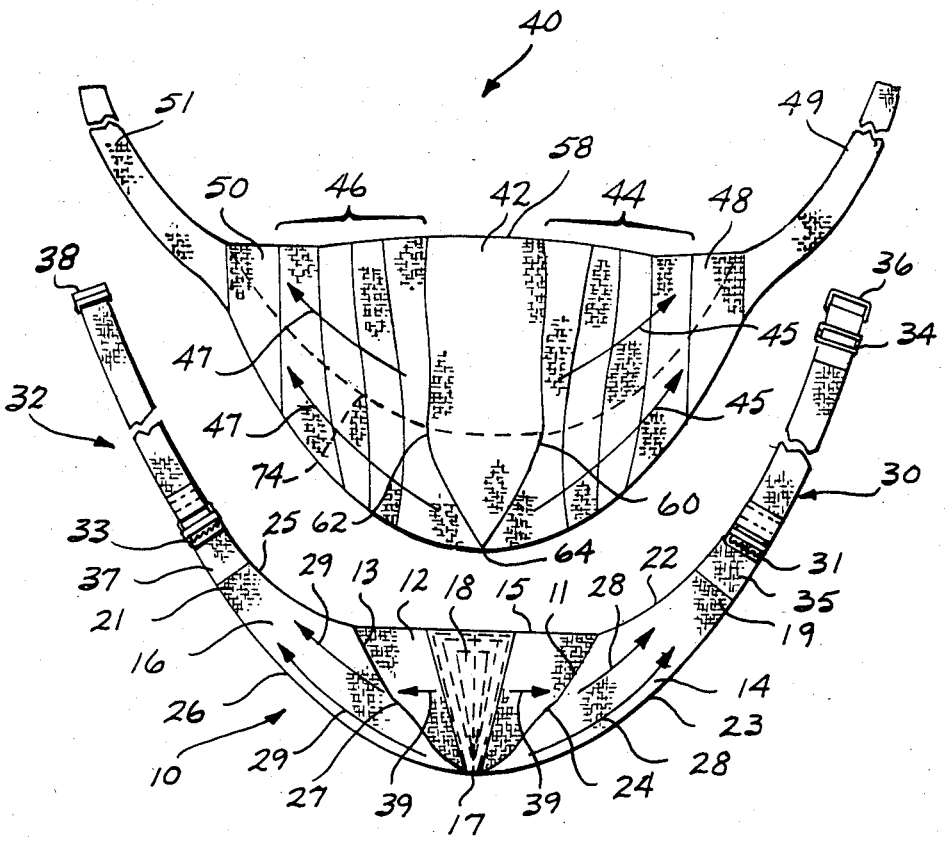
FIG. 1 is a front view of a garment according to the invention showing the shaping panel exploded from the support panel and waistband.
Figure 4:
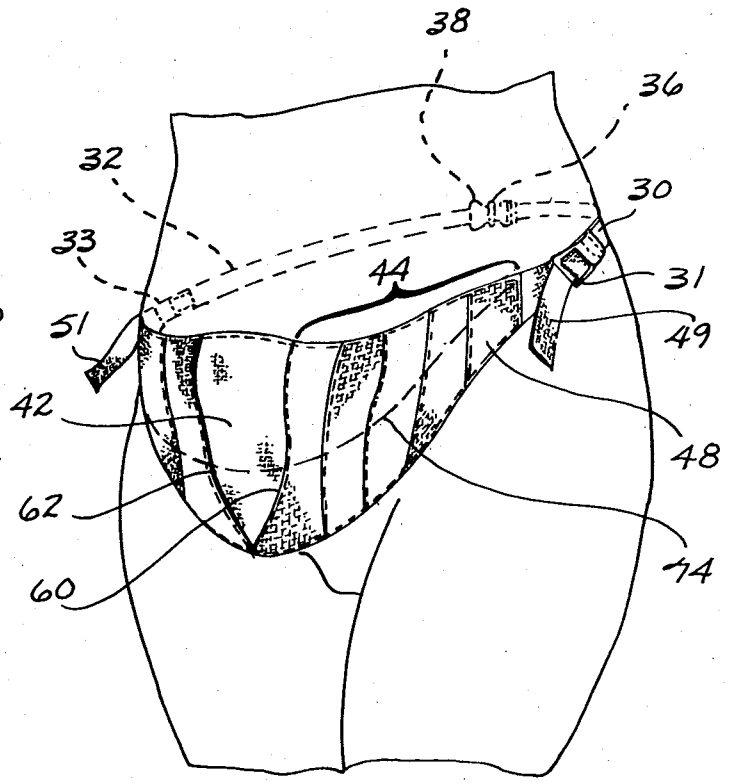
FIG. 4 is a perspective view similar to FIG. 3, but also showing the positioning and operation of the shaping panel.
Figure 3:
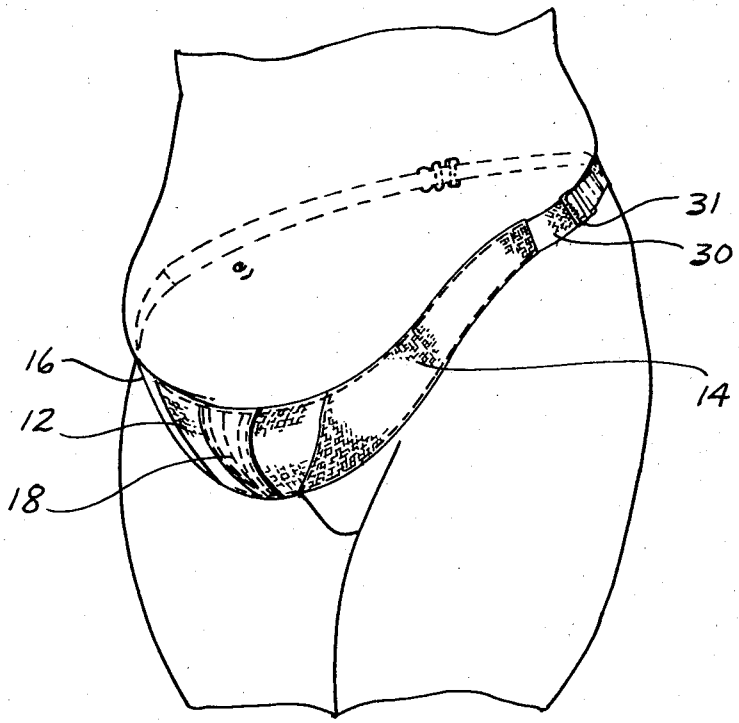
FIG. 3 is a perspective view showing the positioning and operation of the support panel and waistband of the garment of FIG. 1.

Referring to FIG. 1, the abdominal support garment has a shaping panel 40, a support panel 10, and two strips 30 and 32 of a nonelastic belt material such as cotton. The free end of the stip 30 includes an adjustable slider buckle 34 and a loop 36. The free end of the stip 32 includes a hook 38 that cooperates with the loop 36 to provide means for fastening the strips to form a belt, or waistband, which extends around the wearer's waist as shown in FIGS. 3 and 4. Proper fit is obtained by adjusting slider buckle 34 to change the length of strip 30. As seen in FIGS. 3 and 4, when worn, the waistband encircles the side and rear portions of the natural waistline of the wearer terminating generally in the region just over the hipbones. The strips 30 and 32 also include sliders, or adjustable fasteners 31 and 33, respectively, which adjustably connect the shaping panel 40 thereto. In particular, the sliders 31 and 33 receive and releasably secure adjusting straps 49 and 51, respectively, of the shaping panel 40.

The support panel 10 has three interactive components constructed of an elastic material and configured and arranged so as to form a pouch-like support that holds and lifts the abdomen of the wearer in an upward and inward direction. As seen best in FIG. 1, these interactive components comprise a central web 12 and a pair of side webs 14 and 16. The central web 12 has a generally inverted bell or tulip shape with opposed side edges 11 and 13 that, in mirror image fashion, curve from an upper edge 15 first inwardly, then outwardly, then back inwardly to a curved tip 17. The grain of the elastic material along which there is maximum elasticity, is oriented in a horizontal direction for the central web 12, as indicated by the arrows 39 in FIG. 1. An inset web 18 of a nonelastic material, such as nylon, is securely attached, as by stitching, to the central portion of the central web 12. The inset web 18 has a generally inverted trapezoidal shape and extends from the upper edge 15 to the tip 17 of the central web.

The side webs 14 and 16 are mirror image shapes of one another. These side webs 14 and 16 are connected at their outer ends 19 and 21 by suitable means, such as stitching, to the ends 35 and 37 of the strips 30 and 32 that form the belt. Side web 14 has an upper edge 22 and a lower edge 23 that curve generally downwardly and inwardly, but gradually outwardly from one another, from the end 19 to an opposite, inner end 24. As shown in FIG. 1, the inner end 24 of the side web 14 is configured complementary to the side edge 11 of the central web and is connected thereto by stitching. The upper edge 25, lower edge 26, and inner end 27 of the side web 16 are arranged in identical, but mirror image fashion, to their counterparts of side web 14, with the inner end 27 thereof being configured complementary to and sewn to the side edge 13 of the central web.

To provide elastic interaction with the central web 12, the grains of maximum elasticity of the side webs 14 and 16 are oriented at angles relative to the grain of the central web. As indicated by the arrows 28 and 29 in FIG. 1, the side webs 14 and 16 are cut along a curved bias so that they stretch in directions that lie along curved paths from the central web upwards toward the outer ends 19 and 21. For each of the webs 14 and 16, the grain along the inner end 24 and 27 forms an acute angle with the grain of the central web. While these acute angles are generally the same for the two side webs, they are in opposed directions so that the grains at the inner ends of the webs 14 and 16 lie along opposed diagonals relative to the grain of the central web.

The three component webs of the support panel are sized, shaped, and assembled so that the panel normally has no curvature, i.e., it will assume a flat condition when laid on a planar surface. However, as a result of the shapes of the three webs and the orientation of their grains, the support panel undergoes a change in shape when it is worn in position on the lower abdomen. Specifically, when properly positioned, the ends 19 and 21 of the side webs lie generally adjacent the hipbones and are substantially fixed there through the action of the waistband. The support panel is dimensioned so that the elastic webs must be stretched between the two ends 19 and 21 in order to be positioned, and remain positioned, on the lower abdomen. Because of the angular orientation of their grains, the side webs 14 and 16 exert a pulling force along the side edges 11 and 13, respectively, of the central web. Since the central web is made of the identical material and has its grain of maximum elasticity oriented in a horizontal direction, it is less elastic than the side webs in the diagonal direction of the pulling forces. In addition, the central portion of the central web 12 is prevented from stretching by the nonelastic inset web 18 so that, overall, there is only slight lateral, horizontal stretching of the central web. As a result of the combined effects of these relationships, the support panel 10 bows inwardly substantially along its entire length from end 19 to end 21, as seen best in FIG. 3. The curvature is most pronounced in the central web where the upper edge 15 and tip 17 curve toward one another into a generally open C-shaped configuration when viewed in cross section. This produces a pouch that conformably receives the abdomen of the wearer. Since the side webs 14 and 16 are cut along a curved bias, they stretch in the directions of the arrows 28 and 29. This not only allows the side panels to conform smoothly to the body of the wearer, but also produces pulling forces that are directed upwards over the hipbones. As a consequence, the abdomen is not only cupped and held by the pouch-like shape, but also lifted inwardly and upwardly thereby. According to an important aspect of the invention, the degree of force exerted and, thus, the degree of support provided, are directly related to the size of the distention of the abdomen so that the requisite lifting force is always provided.

The lifting support provided by the support panel 10 provides comfort by returning the abdominal wall and organs of the pelvic cavity to their proper anatomical position. If relief from the discomfort associated with weakened abdominal muscles were the only aim, the combination of the support panel and waistband would be an effective appliance. According to an additional aspect of the invention, the combination also includes the shaping panel 40 so that aesthetic reshaping of the anterior abdomen just below the waistline is provided in addition to the provision of comfortable support.

Referring again to FIG. 1, the shaping panel 40 is somewhat similar in design to the support panel 10, having a central web 42 and two side webs 44 and 46. The shaping panel 40 differs, however, in that the central web is nonelastic while the two side webs are elastic. The two side webs 44 and 46 are constructed and arranged so that their directions of maximum elasticity lie along curved paths as indicated by the arrows 45 and 47, respectively, in FIG. 1. It is possible to provide this curved stretchability through the use of an elastic material with sufficient give across the grains so as to curve conformably to the wearer's body when stretched. According to the preferred arrangement, however, the elastic material used for the side webs 44 and 46 does not have a sufficient cross grain give so as to allow smooth curvature across the relatively sizeable area of the side webs. Thus, to provide the required curved stretchability, the side webs 44 and 46 are formed by stitching together four separate strips of elastic material. It is to be appreciated that more or fewer than four strips could be used in order to accommodate different body sizes or shapes. Each of the strips is cut along a bias and assembled relative to the adjacent strips with their grains of elasticity aligned so that when they are stretched in use, they interact to yield pulling forces in the direction of the arrows 45 and 47. Essentially, the respective segments of the side webs 44 and 46 are arranged so that they translate pulling forces from the side edges of the central web 42 laterally outward and upward. As generally indicated by the tails of the arrows 45 and 47, these forces begin at an upward and inward acute angle on the side edges of the central web 42, rather than directly laterally outward. According to an important aspect of the invention, this translation in pulling force occurs in a short lateral distance over the relatively large vertical dimension of the side webs 44 and 46. The pulling forces begin at the relatively narrow adjusting straps 49 and 51. To provide the physical transition to the narrow adjusting straps 49 and 51 and to transfer the forces between the side webs 44 and 46 thereto, the shaping panel includes two nonelastic terminal sections 48 and 50. These terminal sections are attached to the edges of the outermost component strip of the side webs by suitable stitching. Without the curved translation of forces, the effect would be to pull only across the top portion of the side and central webs producing a nonfunctional buckling of the shaping panel.

The central web 42 is less triangular than the central web 12 of the support panel, having the shape of a shield or escutcheon rather than that of a bell. From an upper edge 58, the two side edges follow a curvilinear path, generally curving first outwardly, then inwardly, then back outwardly to bends 60 and 62, then finally inwardly to a tip 64. When the garment is worn, the interactive effect the side webs 44 and 46 on the central web 42 is such as to pull at the bends 60 and 62 and function as if a finger were placed horizontally between these points to push directly inwardly on the abdomen of the wearer. According to an important aspect of the invention, this inward force, coupled with the upward and outward pulling action of the side webs 44 and 46 redistributes and reshapes the "artificial" paunch to yield a dramatic change in appearance, which instantly provides the visual illusion of a loss of weight of ten to thirty pounds or more.

In operation, the shaping panel operates, in part, cooperatively with the support panel 10 to lift and hold the abdomen and, in part, independently to flatten the portion of the abdomen lying below the waistline. To provide this dual action and to permit independent adjustment, the shaping panel 42 is not attached to the support panel 10. Rather, the outermost ends of the adjusting straps 49 and 51 are received by the sliders 31 and 33, respectively, so that the straps may be adjusted to exert the required forces on the support panel. With this arrangement, the shaping panel 40 is positioned in covering relationship in front of the support panel 10 with the tips 64 and 17 of the two panels substantially coinciding. Since the shaping panel 40 has a substantially greater vertical dimension across its entire width than does the support panel 10, it extends upward above the upper edge of the support panel 10 and engages a portion of the abdomen of the wearer as shown in FIG. 4. The relationship of the vertical dimensions is slightly greater than 2:1 at a vertical line drawn through the tips of the two panels and at the outer ends thereof. In the intermediate regions between the center and end points, the vertical dimensions of the two panels bear a somewhat greater relative relationship.

With the above construction and arrangement, the shaping panel 52 has two operating portions. The lower portion, which can be defined as that portion that is superimposed over the support panel 10, lies generally below the imaginary centerline designated 74 in FIG. 1. As a result of the orientation of the grains of the side webs, the shapes therof, and the stretch-preventing presence of the central web 42, the lower portion of the shaping panel changes shape when in use. Specifically, when this panel is positioned, with the remaining components of the garment, on the wearer as shown in FIG. 4, the elastic material of the side webs 44 and 46 is stretched, causing the lower portions of the side panels 44 and 46 to exert a diagonally directed pulling force on the lower portion of the central web 42. As a consequence of the shape of the central web 42, the lower portion of the shaping panel is drawn into a curvilinear shape that is generally like an open "S" in cross section. The upper portion of the "S" begins generally at the bends 60 and 62 and bows inwardly so as to conform to the purch-like shape of the underlying support panel 10. The lower portion of the "S" is smaller than the upper portion and curves, or bows, gently outward. In most women, there is a flattened region immediately below an abdominal protrusion. In use, the lower portion of the "S" tapers smoothly into this flattened contour. This not only prevents the formation of potentially undesirable bulges, but also helps to hold the lower edge of the garment in place so that it is not shifted or otherwise displaced by body movements.

As noted above, the cooperative lifting action of the support panel 10 and the lower portion of the shaping panel 40 forces the portion of the abdomen lying above the support panel to be forced outward into an "artificial" paunch. The upper portion of the shaping panel engages this portion of the abdomen and functions to flatten the same by pushing inwardly in finger-like fashion horizontally across the central portion of the paunch and providing upward and laterally outward forces that spread the excess underlying tissue between the hipbones. It is important to note that the forces that produce this action are translated upwards over the hipbones to the waistband.

As a result of the unique construction and operation of the garment, it remains undetectable under outer garments. Since it neither interacts with nor interferes with the outer garment, it can be worn under a wide variety of clothing. It is also quite easily put on and removed. It is first positioned around the waistline and the adjustable fasteners of the strips 30 and 32 engaged so that the garment encircles the wearer's waist. Thereafter, the support panel is pulled downwardly over the abdomen. As this is done, the elastic webs of the panel respond in accordance with the degree of distention, stretching into the configurations discussed above so as to support the abdomen. Thereafter, the adjusting straps 49 and 51 are pulled through the sliders 31 and 33 to stretch the side webs 44 and 46 of the shaping panel and cause it to operate as described above to reshape the abdomen. The cupping action of the support panel and the lower portion of the shaping panel assure that the garment will not move. Since the crotch, sides of the hips, and buttocks, are totally unaffected by the garment, and since the lower edge of the two panels tapers naturally up toward the hips, an unusual degree of comfort is experienced. Comfort is further enhanced since neither the supporting action nor the flattening action is accomplished with a general compression or restriction of the underlying abdomen.

Figure 2:
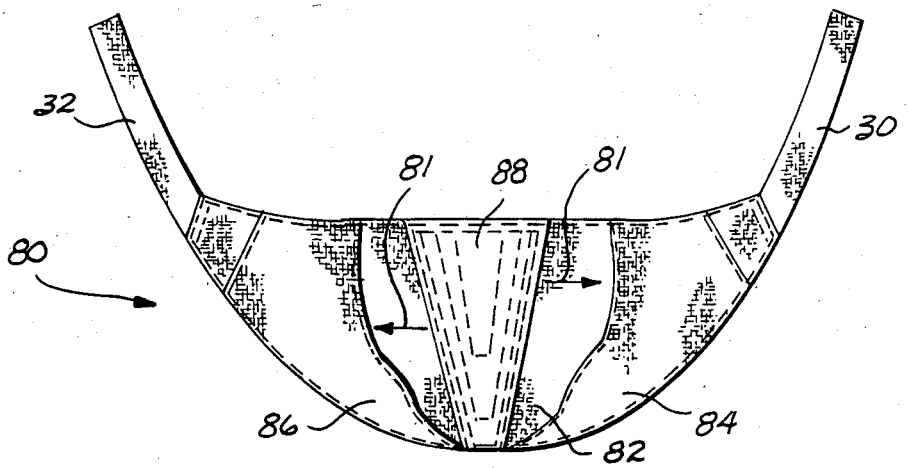
FIG. 2 is a front view of an alternative embodiment of the support panel.

Referring now to FIG. 2, another embodiment of a support panel 80 is shown. This support panel functions in substantially the same way as the support panel 10, assuming a bowed pouch-like configuration when in use to provide inwardly and upwardly lifting support for the abdomen. This panel, however, is intended for use by large women who have substantial weight problems and, thus, require more substantial support. For such use, this panel is substituted for the support panel 10, i.e., is connected to the strips 30 and 32 in lieu of support panel 10 and used with the same shaping panel 40 in the manner discussed above. FIGS. 1 and 2 have the same scale, so as to indicate the size relationship between the support panel 80 and the shaping panel 42. The support panel 80 has a central web 82 that has a general tulip shape. The elastic material used in its construction is oriented so that the grain runs generally in a horizontal direction as indicated by arrows 81. A nonelastic inset web 88 is sewn to the central portion of the web 82 so as to prevent the same from stretching in any direction. The central web 82 is flanked on its two sides by side webs 84 and 86. With this arrangement, the innermost portions of the side webs 84 and 86 have the grain of the elastic material from which they are configured oriented at acute angles relative to the grain of the central web 82 in the same manner as the grains of the webs of the support panel 10 are arranged. The overall effect is identical to that of support panel 10, with the side webs 84 and 86 stretching in curved directions upwards and outwards and generally forming a pouch when stretched over the abdomen. Because of its relatively larger vertical dimension, the support panel 80 extends further upward on the shaping panel 40 than does the support panel 10. In recognition of this, the shape of the component webs of the support panel 80 and the orientation of the elastic material are such that the upper portion of the support panel 80 does not bow significantly inward so as to operationally interfere with the flattening action of the shaping panel 40.

Figure 5:
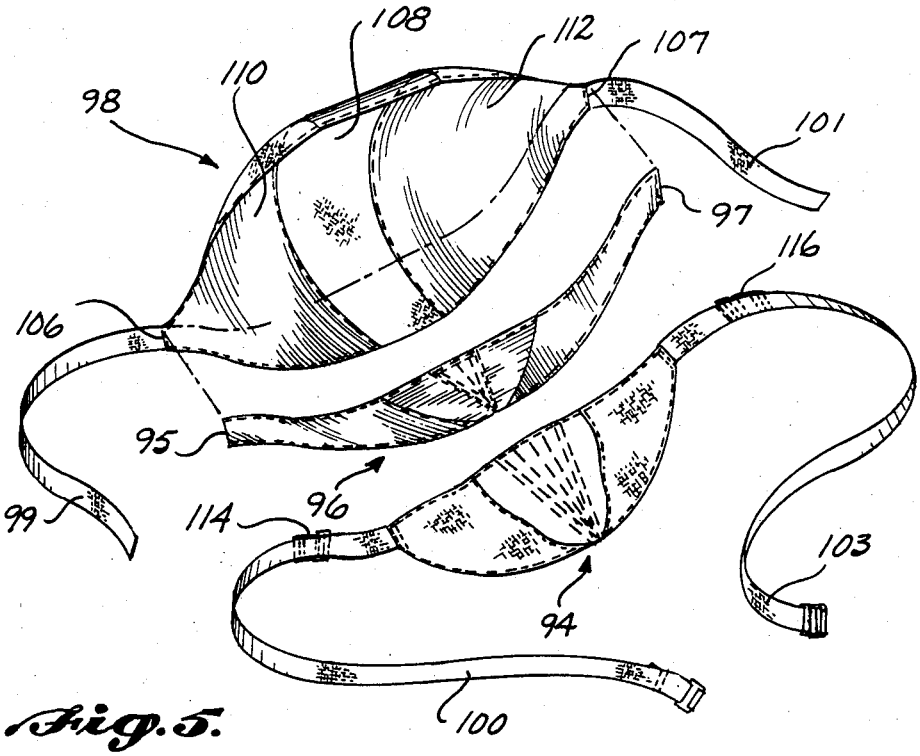
FIG. 5 is an exploded rear perspective view of an embodiment of the invention that is adapted for use during pregnancy.
Figure 6:
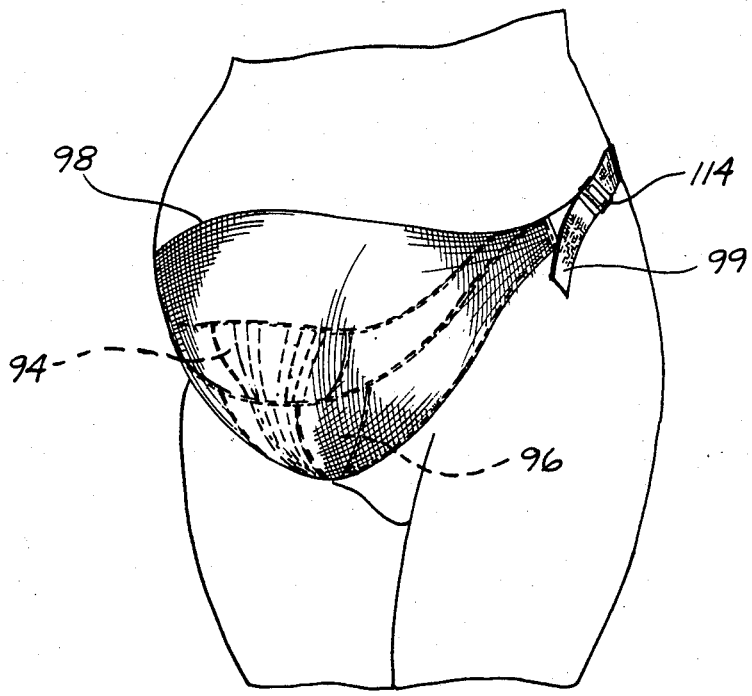
FIG. 6 is a perspective view, in partial section, illustrating the positioning and operation of the garment of FIG. 5.

Referring now to FIGS. 5 and 6, there is shown yet another embodiment of the invention that is particularly adapted to support the abdomen of a woman during pregnancy. This embodiment does not seek to provide cosmetic reshaping, but, rather, only provides support and relief from discomfort by shifting some of the weight of the fetus to the pelvis. Referring to FIG. 5, this garment has three principal components, an inner support panel 94, an intermediate support panel 96, and an outer pouch 98. The inner support panel 94 is identical to the support panel 80 shown in FIG. 2 and is connected to a pair of strips 100 and 103 that are releasably interconnectable with adjustable fastening means such as those used for support panel 10 to form a belt. The intermediate support panel 96 is identical to the support panel 10 illustrated in FIG. 1. As suggested by the broken line in FIG. 5, the intermediate support panel 96 is sewn into the outer pouch 98. The ends 106 and 107 of the pouch and the ends 95 and 97 of the intermediate support panel are connected to nonelastic straps 99 and 101, respectively. To permit adjustment of the combination of the intermediate support panel 96 and outer pouch 98, the straps 99 and 101 cooperate with slider buckles 114 and 116 on the strips 100 and 103, respectively.

Unlike the other support panels that lie flat when not in use, the outer pouch 98 has a generally concave shape. This pouch is formed by stitching together a central web 108 and two side webs 110 and 112. Each of these webs is formed of the same elastic material. The pouch is included for aesthetic reasons to form a cover over the inner and intermediate support panels and the abdomen.

In operation, the garment is placed around the waistline and the two strips 100 and 103 joined. Then, the inner support panel 94 is pulled down and under the wearer's abdomen. Thereafter, the intermediate support panel 96 and outer pouch are pulled down and under the abdomen and the straps 99 and 101 adjusted in the fasteners 114 and 116. When so positioned, the inner and intermediate support panels lift the abdomen inwardly and upwardly so that the weight is shifted back over the hips. With this action, some of the discomforts associated with pregnancy, particularly those relating to strain of the back muscles, are alleviated.

From the foregoing, it will be appreciated that the present invention provides an undergarment that has two cooperative panels that are rendered operative by the body of the wearer to lift and reshape the anterior abdominal wall. The invention also provides a support garment for pregnant women that lifts and supports the abdomen without flattening or compressing the same. While the invention has been described in relation to its preferred embodiment, one of ordinary skill will be able to effect various changes and substitutions of equivalents without departing from the broad concepts disclosed herein. For example, the shaping panel 40 and support panel 10 may be attached to one another rather than being merely attached to the strips that form the waistband. Such attachment could be either complete or at specific points and could be permanent or releasable. For example, releasable attachment could be easily provided by using one or more Velcro fasteners. It is to be noted that releasable attachment has the advantage of permitting a measure of adjustment between the support panel and shaping panel so that the wearer can precisely fit it to her body. It will also be observed that a single belt could be used in place of the two-section belt described herein. Other modifications and substitutions will be apparent from a reading of this specification. It is therefore intended that the protection afforded by Letters Patent granted hereon be limited only by the definition contained in the appended claims and equivalents thereof.

The embodiments of the invention in which an exclusive property or privilege is claimed are defined as follows:

1. A garment for supporting and reshaping the abdomen of a wearer, said garment comprising:

a waistband adapted to engage the waist of the wearer above the hips;

a support panel connected at opposite sides thereof to said waistband and adapted to be positioned on the abdomen below the navel, said support panel, when in use, assuming a pouch-like shape to hold and lift the abdomen of the wearer; and a shaping panel connected at opposite sides thereof to said waistband, said shaping panel having an upper portion and a lower portion, said lower portion being superimposed over said support panel and constructed so as to assume, when in use, a shape that conforms to the pouch-like shape of said support panel, said lower portion cooperating with said support panel to hold and lift the abdomen, said upper portion being positioned above said support panel and constructed so as to engage and flatten that portion of the abdomen which lies between said support panel and the waistline of the wearer.

2. The garment of claim 1, wherein the lower portion of said shaping panel, when in use, assumes a generally S-shape in cross section.

3. The garment of claim 2, wherein said support panel includes a central web flanked by a pair of opposed side webs, each of said webs being constructed of an elastic material having a grain indicative of the direction of maximum elasticity, the grain of said central web being oriented generally horizontally, the grain of each of said side webs being oriented in a predetermined direction relative to the grain of said central web.

4. The garment of claim 3, wherein said shaping panel includes a central web flanked by a pair of opposed side webs, said central web being constructed of a nonelastic material, each of said side webs being constructed of an elastic material having a grain indicative of the direction of maximum elasticity, the grain of each of said side webs being oriented in predetermined directions relative to one another.

5. The garment of claim 4, wherein the central web of said support panel has an inset web attached thereto, said inset web being constructed of a nonelastic material 6. A garment for supporting the abdomen of a woman during pregnancy, said garment comprising:

a waistband adapted to engage the waist of a wearer above the hips;

an inner support panel connected at opposite sides thereof to said waistband and adapted to be positioned on the abdomen of the wearer, said support panel, when in use, assuming a pouch-like shape to hold and lift the abdomen of the wearer;

an intermediate support panel connected at opposite sides thereof to said waistband and superimposed over said inner support panel, said intermediate support panel, when in use, assuming a shape that conforms to the shape of said inner support panel, said intermediate support panel cooperating with said inner support panel to hold and lift the abdomen of the wearer; and an outer pouch superimposed over and connected to said intermediate support panel, said outer pouch being connected at ends thereof with said waistband, said outer pouch extending upwards from said intermediate support panel and conformably engaging the abdomen of the wearer.

7. The garment of claim 6, wherein:

said inner support panel includes a central web flanked by a pair of opposed side webs, each of said webs being constructed of an elastic material having a grain indicative of the direction of maximum elasticity, the grain of said central web being oriented generally horizontally, the grain of each of said side webs being oriented in predetermined directions relative to the grain of said central web; and said intermediate support panel includes a central web flanked by a pair of opposed side webs, each of said webs being constructed of an elastic material having a grain indicative of the direction of maximum elasticity, the grain of said central web being oriented generally horizontally, the grain of each of said side webs being oriented in predetermined direction relative to the grain of said central web.

8. The garment of claim 7, wherein the central web of said inner support panel and the central web of said intermediate support panel each has an inset web attached thereto, each of said inset webs being constructed of a nonelastic material.

9. The garment of claim 8, wherein said outer pouch includes a central web flanked by a pair of opposed side webs, each of said webs being constructed of an elastic material.

* * * * *

UNITED STATES PATENT AND TRADEMARK OFFICE

CERTIFICATE OF CORRECTION

PATENT NO. : 4,596,253

DATED : June 24, 1986

INVENTOR(S) : Johnnie R. Griffith

It is certified that error appears in the above-identified patent and that said Letters Patent is hereby corrected as shown below:

Column 3, line 44, "sideswards" should be --sidewards--
Column 3, line 57, "extend" should be --extent--
Column 5, line 16, "stip" should be --strip--
Column 5, line 17, "stip" should be --strip--
Column 8, line 43, "purch-like" should be --pouch-like--
Column 11, line 47, "material" should be --material.--
Column 12, line 39, "direction" should be --directions--

Signed and Sealed this

Tenth Day of March, 1987

*Attest:*

DONALD J. QUIGG

*Attesting Officer*

*Commissioner of Patents and Trademarks*